US005325601A

United States Patent [19]

Brownewell et al.

[11] Patent Number: 5,325,601

[45] Date of Patent: Jul. 5, 1994

[54] METHOD FOR DRYING AND CURING A COATED METAL SUBSTRATE

[75] Inventors: Donald L. Brownewell, Naperville; Louis S. Comadena, Burr Ridge; Dwight B. Raddatz, Woodridge, all of Ill.

[73] Assignee: Alltrista Corporation, Muncie, Ind.

[21] Appl. No.: 1,202

[22] Filed: Jan. 5, 1993

Related U.S. Application Data

[63] Continuation of Ser. No. 686,961, Apr. 18, 1991.

[51] Int. Cl.[5] ..... F26B 3/34

[52] U.S. Cl. ..... 34/247; 34/68; 34/423; 118/58; 118/643; 427/543; 427/372.2; 427/379

[58] Field of Search ..... 34/1 B, 17, 18, 68; 427/379, 380, 372.2, 543, 544; 118/58, 643

[56] References Cited

U.S. PATENT DOCUMENTS

| | | |
|---|---|---|
| 1,745,437 | 2/1930 | Motley . |
| 2,833,672 | 5/1958 | Laubscher et al. . |
| 3,058,840 | 10/1962 | Kerr et al. . |
| 3,068,119 | 12/1962 | Gotsch . |
| 3,424,886 | 1/1969 | Ross . |
| 3,561,131 | 1/1971 | Swartz . |
| 3,576,664 | 4/1971 | Swartz . |
| 3,667,095 | 6/1972 | Ostrowski et al. . |
| 3,696,503 | 10/1972 | Krenger et al. . |
| 3,935,330 | 1/1976 | Smith et al. . |
| 4,370,357 | 1/1983 | Swartz . |
| 4,680,871 | 7/1987 | Reznik . |
| 4,694,586 | 9/1987 | Reznik . |
| 4,761,530 | 8/1988 | Scherer et al. . |
| 4,849,598 | 7/1989 | Nozaki et al. . |
| 5,079,034 | 1/1992 | Miyake et al. . |

FOREIGN PATENT DOCUMENTS

| | | |
|---|---|---|
| 0013218 | 7/1980 | European Pat. Off. . |
| 0807080 | 6/1951 | Fed. Rep. of Germany . |
| 785572 | 10/1957 | United Kingdom . |

OTHER PUBLICATIONS

Letter dated Oct. 26, 1988 from Raztek Corporation to Donald Brownewell.

Letter dated Sep. 26, 1988 from Giegel Associates to Louis Gomadena.

Article entitled "Induction heat: Quick cure for coated oil" from Apr. 1988 edition of Modern Metals.

European Search Report from the E.P.O. dated Jul. 14, 1992, received in an application corresponding to the grandparent case (SN 07/686,691).

Abstract—World Patents Index, Week 3, 1979.

Abstract—Patent Abstracts of Japan, vol. 11, No. 103, (C-340) Apr. 18, 1986.

*Primary Examiner*—Denise Gromada

*Attorney, Agent, or Firm*—Willian Brinks Hofer Gilson & Lione

[57] ABSTRACT

A method and apparatus for drying and curing a coating which as been applied in liquid form to a metal substrate. The process and apparatus include a precuring or drying of the coating by rapidly heating the sheet in an electromagnetic induction coil to volatilize solvents in the coating. The precured sheets are then immediately conveyed to a conventional convection oven for further heating the sheets by baking the sheets at a temperature and for a duration in accordance with the drying and curing specifications of the coating manufacturer. The induction coil is designed to heat the sheet metal in a narrow transverse band as the sheet moves through the induction coil. The power supply to the induction circuit is designed to permit the induction coil to be turned on under varying load.

9 Claims, 8 Drawing Sheets

METHOD FOR DRYING AND CURING A COATED METAL SUBSTRATE

This is a continuation of copending application Ser. No. 07/686,961 filed on Apr. 18, 1991.

BACKGROUND OF THE INVENTION

This invention relates to a method and apparatus for coating metal in either sheet or coil form with a protective or decorative coating and for drying and curing the coating. The invention is particularly directed to a method and apparatus for drying and curing a liquid coating which has been applied to individual sheets of a metal substrate. The invention also includes a sheet produced by the process of the present invention.

Sheet metal which is to be utilized for producing various products, such as metal cans and ends and decorative metal pieces, may have a coating applied to the metal for protective or decorative purposes. The metal can be in coil form or in the form of individual sheets. The protective coating is usually applied to the metal in liquid form by various techniques well known to those skilled in the art, such as a roller coater, dipping, spraying and the like, as the metal substrate is passed through the coater. Various coatings and inks can be used which are well known to those skilled in the art, including for example, vinyls, epoxys, alkyds and phenolics. These coatings include various resins and pigments dissolved in a solvent. The solvent can be either a volatile organic solvent or may be an inorganic solvent, such as a water based solvent.

The present invention is primarily directed to coating individual sheets of ferromagnetic metal with or without tin or other metal coatings and having a gauge of approximately 0.004 to approximately 0.060 inches. The sheets may be rectangular and have a size, for example, of up to 54 inch by 56 inch. These dimensions are intended to be examples only and are not provided by way of limitation. The invention may also be applicable to similar gauge metal in coil form.

As will be appreciated by those having ordinary skill in the art, the normal practice is that liquid coating which has been applied to the metal substrate is dried and cured by the application of heat. The coating manufacturer usually specifies the temperature to which the coated metal must be heated and the duration for which the coated metal must be maintained at the specified temperature to achieve a proper cure of the coating.

Prior to the present invention, the most commonly used method of and apparatus for drying and curing the coating applied to metal in coil or sheet form was the use of a gas fired convection oven. The coated metal sheet or coil is baked by being slowly conveyed through the gas fired convection oven, whereby the metal sheet and coating are gradually heated to the desired temperature, maintained at that temperature for the specified duration. The oven may include a cooling zone to gradually reduce the temperature of the metal substrate to a point where it can be handled by appropriate material handling apparatus without damaging the protective or decorative coating. A normal cure cycle for organic coatings inks and solvents utilizing a conventional gas fired oven is two minutes to bring the metal up to cure temperature followed by maintaining the sheet at cure temperature for eight minutes to drive off the remaining solvent and provide the proper cross linking of the molecules to provide a cured coating.

In the case of individual sheets which have been coated, the convection oven typically includes a plurality of spaced apart wire wickets mounted on an endless conveyor chain. The coated metal sheets are transported to the convection oven where an individual wicket picks up an individual sheet of coated metal and conveys it in a generally vertical position through the convection oven. Hot gases generated in the natural gas convection oven circulate around the metal sheet to cure the coating. The wicket will discharge the sheet which has been dried and cured onto suitable material handling apparatus at the outlet of the oven.

In a convection oven, the coated metal substrate is heated from the outside causing a skin to be formed on the surface of the coating. This skin will serve to trap liquid solvents in the coating below this skin. In order to overcome this tendency, the coating manufacturer will add expensive and environmentally unfriendly retarding agents to the coating to prevent rapid cure of the coating surface prior to the release of solvents and product release compounds. These retarding agents not only add to the cost of the coatings, but also increase unwanted hydrocarbon emissions.

A further problem with utilizing convection ovens is that "wicket ghosting" can occur. The wire wickets which support the sheets in a vertical position are often preheated to insure proper cure of the coated sheet which is in contact with the wicket. When the cold sheet contacts the hot wicket, the heat drives the solvent and volatile products from the sheet on and around the wicket-sheet contact area. This condition can change the appearance and sometimes the color of the sheet. This produces a silhouette pattern in the shape of the wicket on the sheet. The resulting sheet may be unacceptable to the user and have to be scrapped. It is found that by utilizing the precuring process and apparatus of the present invention, the temperature differential between the wicket and the precured sheet can be kept to a minimum to substantially reduce or eliminate wicket ghosting.

A further disadvantage of the use of convection ovens is that the solvents which are fumed or volatilized by the heat from the convection oven tend to contaminate the conveying mechanism, burners, controls and exhaust duct of the convection oven through the formation of soot which may be generated when the solvents contact the open flame of the convection oven. Fires can result which may damage not only the convection oven, but also the coated sheets which are contained in the convection oven. In addition, the volatilized solvents must be captured or incinerated following the convection oven in order to comply with environmental requirements. With the use of a convection oven only, since the solvents are mixed with the products of combustion of the convection oven, they cannot be condensed and recycled.

Prior to the present invention, it was known to utilize electromagnetic induction coils for heating the metal substrate to cure the liquid coatings which have been applied to the metal in coil or sheet form. The use of an electromagnetic induction coil has the advantage that the metal is rapidly heated from the inside outwardly toward the surface of the coating. Heating is accomplished by passing the coated strip through or under an electromagnetic induction coil to produce eddy currents in the sheet metal to rapidly heat the metal. Because the coating is heated from the inside out, a skin is not formed on the surface of the coating and the volatilized solvents are allowed to escape through the still liquid surface of the coating. Some examples of prior apparatus and methods for coating metal strip in coil form are shown in U.S. Pat. Nos. 3,561,131 and 3,576,664, issued to Swartz, and U.S. Pat. Nos. 4,680,871 and 4,694,586, issued to Reznik, and U.S. Pat. No. 4,761,530, issued to Scherer et al. In many applications, the metal which has been heated in the induction coil is promptly cooled.

With the use of an induction coil, the solvents can be volatilized and then condensed in a condenser for further use. This reduces emissions to the atmosphere, thereby reducing environmental problems, and has the economic advantage of being able to recycle the solvents. Examples of prior patents which disclose condensing volatilized solvents include the aforesaid patents to Reznik and Swartz, as well as U.S. Pat. No. 4,370,357 to Swartz.

Induction curing is usually a rapid curing process and may not be suitable by itself for meeting the coating manufacturer's specifications for curing the coating. Further, total curing in an induction coil may not be energy efficient.

Prior to the present invention, induction heating has been usually applied to coiled materials, such as flat metal coil and wire, whereby the metal can be unwound from one coil, passed through the induction coil to heat the metal, and then immediately wound onto another coil. A conveyor mechanism need not be passed through or near the induction coil.

Sheets of material have been coated and cured in a process and apparatus described in U.S. Pat. No. 3,068,119, issued Dec. 11, 1962, to Gotsch. The patentee describes an increase in temperature at a rate of 200° F. per second to achieve a temperature of between 500° and 800° F. by moving the coated sheet through the induction coil at a rate so that the coated sheet spends 2 to 5 seconds within the heating zone. The patentee then proposes to hold the coated sheet at the elevated temperature for a period of time. The patentee does disclose certain advantages of the use of an induction heating method and apparatus, but does not disclose details as to how to convey the individual sheets of material through the induction coil or how to prevent overheating of the metal substrate, particularly near the edges of the substrate.

SUMMARY OF THE INVENTION

It has been found by the present invention that it is advantageous to combine the advantages of the method and apparatus for curing coatings which have been applied in liquid form to a metal substrate by heating the metal by means of an electromagnetic induction coil with the advantages of drying and curing a coating which has been applied to a metal substrate by heating the metal in a convection oven. Broadly speaking, this is accomplished by utilizing an electromagnetic induction coil as a means for precuring or drying the coating by rapidly raising the temperature of the metal substrate to a first temperature sufficient to volatilize or fume solvents contained in the coating and then immediately conveying the precured metal sheet to a convection oven where the sheet is subjected to a programmed bake. In this programmed bake, the metal sheet is continuously conveyed through the convection oven and is gradually raised to that temperature specified by the coating manufacturer as necessary to cure the coating and retained at that temperature for the duration specified by the coating manufacturer to achieve complete drying and curing of the coating. As the sheet completes its movement through the convection oven, the programmed bake cycle may include a gradual cooling to that temperature which permits further material handling.

For the purpose of this disclosure, the term "drying" will mean the substantial (more than 50%) removal of volatile organic or inorganic constituents of the coating.

Also for purposes of this disclosure, the term "curing" refers to the conversion or transformation of properties of a plastic or resinous material (thermoplastic or thermosetting) by chemical reaction, which, for example, may be condensation, polymerization or addition by means of heat and/or catalyst. In some cases, catalysts are added to the coating before application to the sheet to facilitate the curing process.

It is therefore the principle object of the present invention to provide a method and apparatus for drying and curing a coating which has been applied to a metal substrate which overcomes the disadvantages of prior methods and apparatus for drying and curing a coating which has been applied to a metal substrate.

It is a further object of the present invention to provide a method and apparatus for drying and curing a coating which has been applied to a metal sheet which is believed to avoid or substantially reduce the necessity of utilizing retarding agents in the coating while meeting the coating manufacturer's specifications for drying temperature and duration.

It is a still further object of this invention to provide a method and apparatus for precuring coatings which have been applied to a metal substrate.

It is a still further object of this invention to provide a method and apparatus for curing coatings which have been applied to a metal substrate which improves environmental and economic use of the solvents by permitting the volatilized solvents to be collected and recycled.

It is a further object of this invention to provide improved coated products by eliminating wicket ghosting and margin wicking.

It is still another object of this invention to provide a coated ferromagnetic sheet produced by the process of the invention.

In general, these and other objects will be carried out by providing a process for drying and curing a coating on a metal substrate, including the steps of inductively heating the coated metal substrate, and then further heating the coated metal substrate in a convection oven until the coating has been raised to substantially the temperature and for the duration required to achieve curing of the coating.

The invention will also be carried out by providing an apparatus for drying and curing a coating which has been applied in liquid form on a substantially flat metal sheet comprising a first means for rapidly heating the flat metal sheet to a first temperature sufficient to substantially dry the coating, a second means for gradually heating the metal sheet to a second temperature and maintaining said temperature for a period of time sufficient to cure the coating and means for conveying the coated metal sheet through the first means to the second means.

The present invention utilizes an electromagnetic induction coil for precuring or drying the coating which has been applied to the metal substrate. The metal substrate is passed through an electromagnetic induction coil, where the magnetic flux generated by the induction coil produces eddy currents in the metal substrate, thereby heating the metal from inside toward the coated surface. This forces the solvents, internal lubricants and product release contents contained in the coating to the coating surface. Because the coating surface is still in a liquid state and has not skinned over, the volatilized solvents are released to the atmosphere. There is a rapid release of the solvents in a fume and may be referred to as "fuming". This skinning over is a solvent-trapping condition which can exist when coated sheets are dried and cured in conventional gas fired convection ovens where the coated metal sheet is inherently heated from the outside. In order to eliminate skinning over, coating manufacturers add retarding agents to the coating. These retarding curing agents add expense to the coating.

In the present invention, because the solvents and other volatilized products are driven away or fumed from the inductively heated substrate surface, more coating particles have a better chance to adhere to the substrate for a more homogeneous bond causing adhesion between the coating and the substrate to form a more substantial bonding condition. In addition, the internal lubricants and "meat" or product release contents contained in the coating are driven to the outer surface where they are needed for container manufacturing operations. Laboratory tests indicate that in some cases with sheets coated according to the present invention compared to sheets coated according to prior practice, the surface friction of the coated metal has been reduced by up to 50% and internal lubricants have been reduced by as much as 30% while maintaining the required coefficient of friction and meat release characteristics of the coated metal. This will permit in some cases the use of a cost efficient, less exotic solvent in the coating to be substituted for more expensive solvents. The use of less exotic solvents will make environmental protection agency compliance less stringent.

While the concept of using an electromagnetic induction coil to heat metal substrate to cure a coating and its consequential advantages of heating the metal from the inside are known, heretofore, the induction coil process has been used to completely cure the coating. This has a tendency to heat the metal to the end temperature faster than is desirable for proper curing and the inability to hold the coated sheet at the desired temperature for a sustained period of time. Continued exposure to the influence of the induction coil will result in an ever increasing metal temperature. With thin gauge metal, this can result in overheating and consequent deformation, especially at the edges. By the present invention, the induction coil is used as a first means for heating the sheet to precure the coating on the sheet. This is done by rapidly heating the sheet to a first temperature. As used herein, "rapid" means heating that portion of the sheet which is within the influence of the magnetic flux field generated by the induction coil to the temperature necessary to precure the sheet or fume the solvents in the coating in less than 0.5 seconds. For example, in one application coated metal sheets having a gauge in the range of 0.004 to 0.060 inches are heated to a temperature of 200° F. in 0.3 seconds. If the solvent is water based, the temperature in the drying or induction heating step of the process should exceed the boiling point of water to achieve the desired fuming of the solvent.

An advantage of the induction precure process of the present invention is that the volatilized or fumed solvents can be captured by installing a separate exhaust hood and duct above the precuring stage of the process, whereby the released solvent fumes from the induction coil area can be exhausted directly to a remotely located condensing coil where the fumes are condensed into a liquid solvent which can be reused. This prevents the solvent from becoming contaminated by oven combustion gases, oven particulates, oils and by-products of the conventional gas fired oven, including hydrocarbon oven emissions. Further, extraction of the solvent at the front of the oven keeps the convection oven wickets and conveyor mechanism cleaner for longer periods of time.

A further advantage of the present invention is that wicket ghosting can be significantly reduced or eliminated. With the present invention, the sheet is heated by the induction coil to a temperature which will be substantially equal to the temperature of the wicket which conveys the coated sheet through the convection oven. Since both the sheet and the wicket are at approximately the same temperature, the silhouette pattern which may occur on the sheet when a hot wicket contacts a cold sheet is eliminated.

Another advantage of the present invention is that "margin wicking" has been substantially reduced. Margin wicking is a flow problem that exists with some coatings when baked with conventional gas fired convection ovens. The metal substrate in many cases acts as an absorbing agent which causes the coating to flow into areas where the metal substrate must be kept absolutely clean to accommodate the following container forming and fabrication processes. It is believed that margin wicking is substantially reduced by the rapid heating of the metal in the induction coil which sets or precures the coating so that it will not flow into uncoated areas on the sheet.

A further advantage of the induction precure or drying of the present invention is that the coating surface in many cases appears to be more glossy. It is believed that the volatile by-products and solvents being emitted through the coating surface prior to final curing causes sufficient agitation within the coating to produce a more even, glossy surface texture on the finally cured sheet.

It has further been found that when utilizing the precuring process using an induction coil followed by a programmed bake in a convection oven as contemplated by the present invention, with some types of coatings, a coating thickness of up to 60 mg per 4 square inches may be applied and cured in a single production pass. If only a conventional convection oven is used, it is believed that approximately 35 mg per 4 square inches is the maximum coating thickness which may be applied. In many situations, the use of induction precure according to the present invention may eliminate the need for an additional coating layer or second pass through the production curing line. This can significantly reduce costs and spoilage which necessarily occur when a metal sheet must be coated a second time.

The present invention utilizes an electromagnetic induction coil which is configured to produce a substantially equal gradient of magnetic flux across the coil to provide a substantially equal heating across the width of the sheet, i.e., within plus or minus 5° F. The induction coil has a width which is less than the length of the individual sheet which is being heated. These combined features serve to heat a narrow transverse band of the metal sheet as it moves through the induction coil, thereby reducing the tendency to overheat the leading and trailing edges of the sheet and to substantially avoid overheating the edges of the sheet. This is particularly important where the sheets of metal have scalloped edges. In order to prevent overheating and deformation of the side edges of the sheet, the coil is preferably in a pancake toroidal flattened solenoid shape with the ends of the toroidal coil opened to a diameter larger than the height of the coil.

The invention includes a control circuit that allows the induction generator to be turned on without a load, i.e., without a ferromagnetic sheet within the induction coil. This is referred to as a "ramp circuit". The ramp circuit slowly brings the induction generator to a preset power level allowing sufficient time for the induction generator and load coil detection circuits to sense if a sheet is in the magnetic field area of the load coil. If a sheet is not present, the induction generator output will be turned off until a sheet is sensed. When a sheet is sensed, the induction power output at the load coil will be proportional to the size of the sheet sensed in the coil area so that constant heat is maintained throughout the rectangular sheet and odd sized cut sheets.

The invention also incorporates a double sheet detector to be sure that sheets within the induction coil do not overlap. Such overlapping could cause arcing between the two sheets, causing damage to those sheets and a possible fire within the system.

The invention also incorporates a sheet detection apparatus to be sure that a sheet which is conveyed into the induction coil is conveyed out of the induction coil and, if this is not accomplished, the conveyor system and the induction coil are shut down. This is important to prevent overheating of sheets in the induction coil and a possible fire situation.

The invention also utilizes an antistatic conveyor belt system for transporting the sheets to be dried and cured through the induction coil to the convection oven. This conveyor system includes a suitable arrangement for grounding the sheets to dissipate an electrostatic charge of the sheets which have passed through the induction coil and prior to being supplied to the convection oven.

A suitable grounded vacuum stop known to those in the art will be located at the discharge of the conveyor system and inlet to the convection oven.

The improved coated ferromagnetic sheet produced by the process of the present invention has the advantage that lubricants and meat release components of the coating are driven to the outer surface. This improves subsequent metal forming operations through reduced friction. With the improved sheet of the present invention, the coating particles have a better opportunity to adhere to the ferromagnetic substrate. The finished sheet is believed to have a more even, glossier surface compared to sheets produced by prior practice.

BRIEF DESCRIPTION OF THE DRAWINGS

The invention will be described in connection with the annexed drawings wherein.

DESCRIPTION OF THE PREFERRED EMBODIMENT

Figure 1:
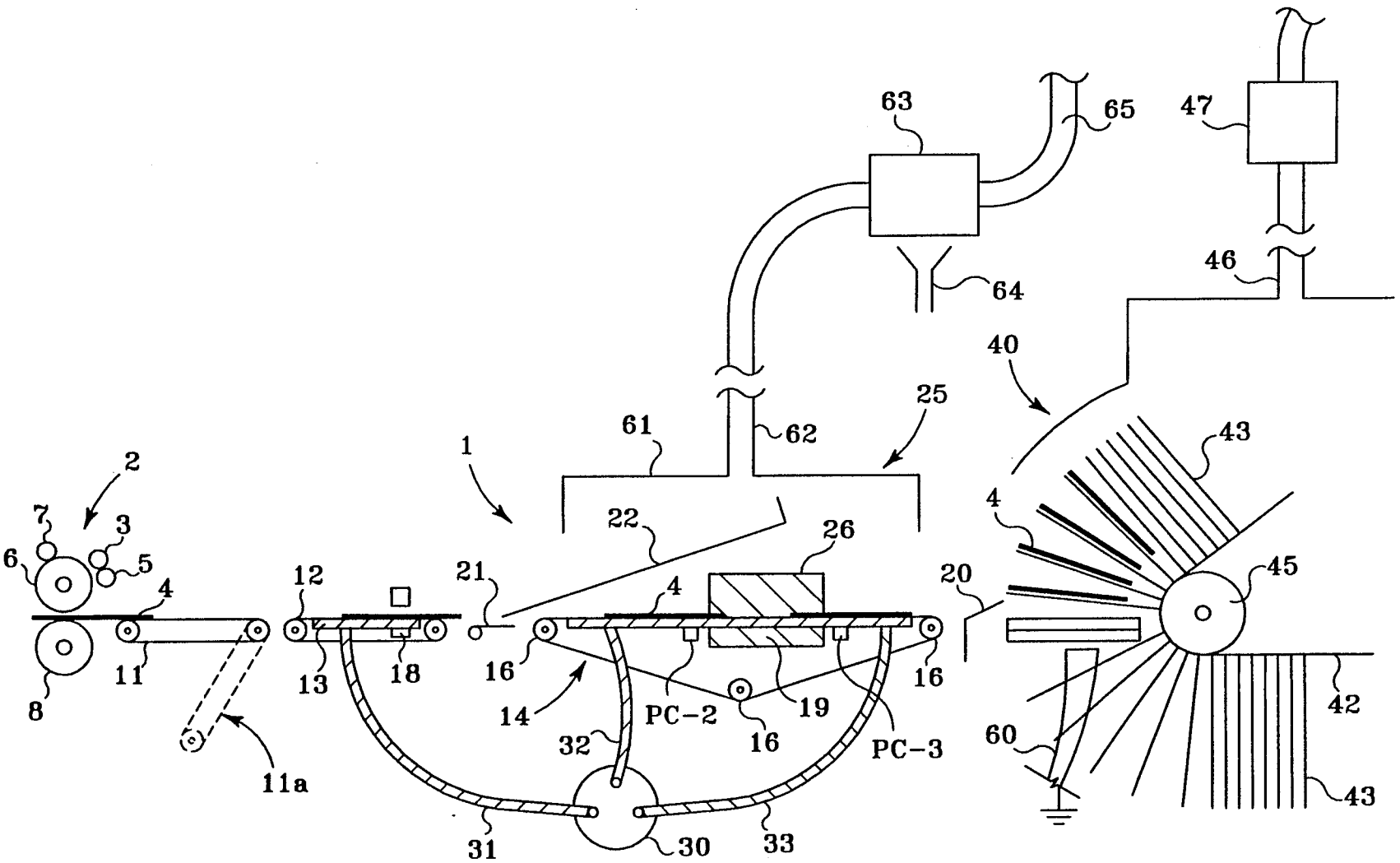
FIG. 1 is a diagramatic view of the overall apparatus of the present invention.

Referring to FIG. 1, the apparatus for drying and curing a coating on a metal substrate is generally designated at 1. This apparatus includes a means for applying a liquid coating to a metal substrate preferably in individual or discrete sheet form. The individual sheets are indicated by the numeral 4.

The apparatus further includes a first means 25 for precuring or drying the coated sheets by heating the sheets to a first temperature. This first means includes an electromagnetic induction coil generally indicated at 26. The apparatus further includes a second means 40 for receiving the precured or dried metal sheet from the induction coil and for baking the sheets by gradually heating the sheet to a second temperature and for maintaining the second temperature for a period of time sufficient to cure the coating. The programmed bake may also include gradually cooling the sheets. The apparatus further comprises a means 10 for conveying the coated metal sheet through the first means 25 to the second means 40.

In the illustrated embodiment, the means 2 for applying a liquid coating to the top surface of the sheet 4 is in the form of a roller coater of a design generally known to those skilled in the art. It has been found with the curing process of the present invention that, compared with prior practice, coating thickness can be increased. In the illustrated embodiment, a separate, speed regulated independent drive system (not shown) is installed to drive the fountain metering roller 5. This allows for separate speed control of roller 5 so that this roller can be operated at a reduced speed compared to metering roller 3 which is driven by coater roller 6. The differential speed of metering rollers 3 and 5 is believed to cause a shearing action on the coating so that thickness application can be maintained within three milligrams or less per four square inches of coating area.

Flashing or coating smoothing roller 7 has been added to the conventional coater to provide for better coating distribution across the entire length of the metering rollers. This roller 7 is nonpowered and is supported by the coater driven metering rollers. The weight of the roller causes friction between the coating and the driven roller 3, which turns the flashing roller 7 at a sufficient speed to aid in leveling out the coating prior to its passing between the metering rollers 3 and 5. This roller modification proves beneficial when running high solids content coatings where the viscosity is very high because thinning agents, solvents and thinners are kept to a minimum.

The means 10 for conveying the coated sheet includes a first conveyor 11 which can be in the form of a conveyor drop gate for receiving sheets 4 from the roller coater 2. Conveyor section 11 may be moved from the position shown in solid lines to the position 11*a* shown in phantom if it is necessary to service the roller coater 2.

Figure 2:
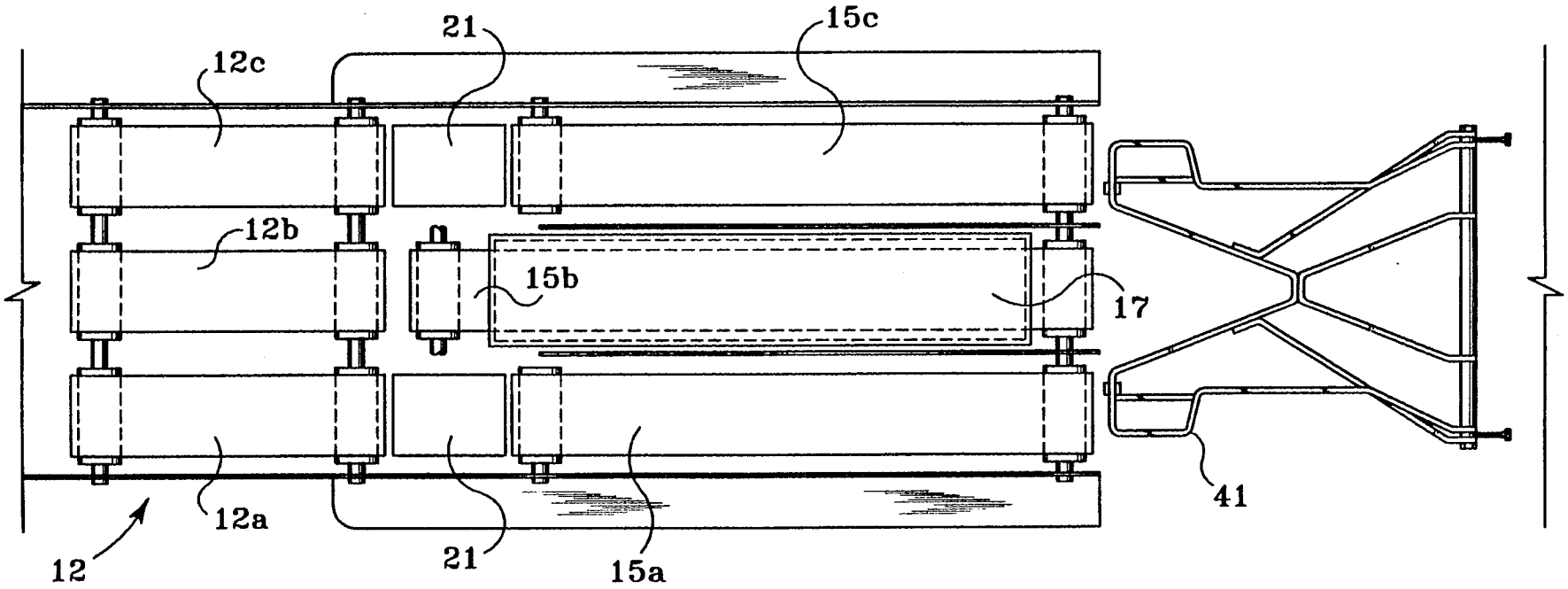
FIG. 2 is a plan view of the conveyor mechanism of the present invention looking up at the bottom of the conveyor.

The conveyor 10 includes a second conveyor or in-feed conveyor 12, including one driven sprocket and one idler sprocket and a belt, a conveyor belt and a vacuum plenum chamber 13. As shown in FIG. 2, it is preferred that there be three belts 12*a*, 12*b* and 12*c* with center belt 12*b* being porous to permit a vacuum to be drawn therethrough. A double sheet detection apparatus 18 generally known in the art is operatively associated with conveyor 12. The double sheet detector 18 may include a proximity detection device set so that the magnetic flux for a single sheet is a predetermined amount. If there are two sheets or overlapped sheets, then the magnetic flux will exceed the predetermined amount. Double sheet detection devices of the type utilized in the present invention are available from Hyde Park of Dayton, Ohio or Detectronics of Elgin, Ill. The double sheet detection device is required to prevent two overlapping sheets from entering the induction coil at the same time. When two sheets enter the coil, the currents produced in each individual sheet are of opposite polarity, which causes heating and arcing between the two sheets. If more than two sheets are sensed entering a coil at the same time, the induction generator and in-feed conveyor 12 are turned off.

The conveyor 14 for transporting coated sheets through an electromagnetic induction coil includes antistatic belting 15 to drain any frictional static charges picked up by the sheet and return this charge to ground potential through the grounded conveyor belt pulleys 16. As shown in FIG. 2, the conveyor 14, like conveyor 12, includes three narrow belts 15*a*, 15*b* and 15*c* with the center belt 15*b* being porous and operatively associated with a vacuum plenum chamber 17.

Figure 6:
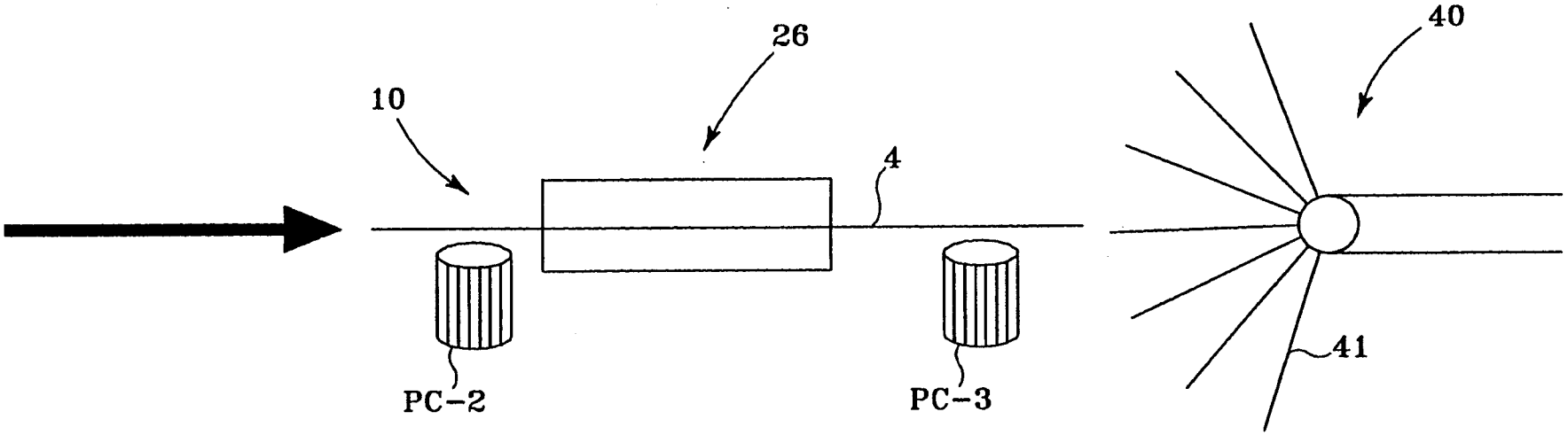
FIG. 6 is a diagramatic view of the sheet detection apparatus incorporated in the present invention.

Sheet detection switches PC-2 and PC-3 are infrared proximity switches, shown diagramatically in FIG. 1 and in FIG. 6, are installed as a safety precaution. These detectors are installed at the entrance and exit sides of the coil 26 to detect possible jam ups. First sensor PC-2 is operatively associated with conveyor 10 and is positioned upstream of coil 26 in the direction of travel of sheets 4 and senses the presence of a sheet. Second sensor PC-3 is also operatively associated with conveyor means 10 and is positioned downstream of coil 26 in the direction of travel of sheets 4. After detector PC-2 senses a sheet, detector PC-3 is given a few tenths of a second to detect the same sheet. Once the detector PC-3 has detected the sheet 4, detector PC-2 has a predetermined period of time to detect a second sheet 4 and detector PC-3 has a predetermined period of time to be clear of the first sheet before detection of a second sheet. If any of these sequences are not followed in the established programmed manner, the induction coil 26 will be turned off and the conveyor system will be shut down.

Figure 5:
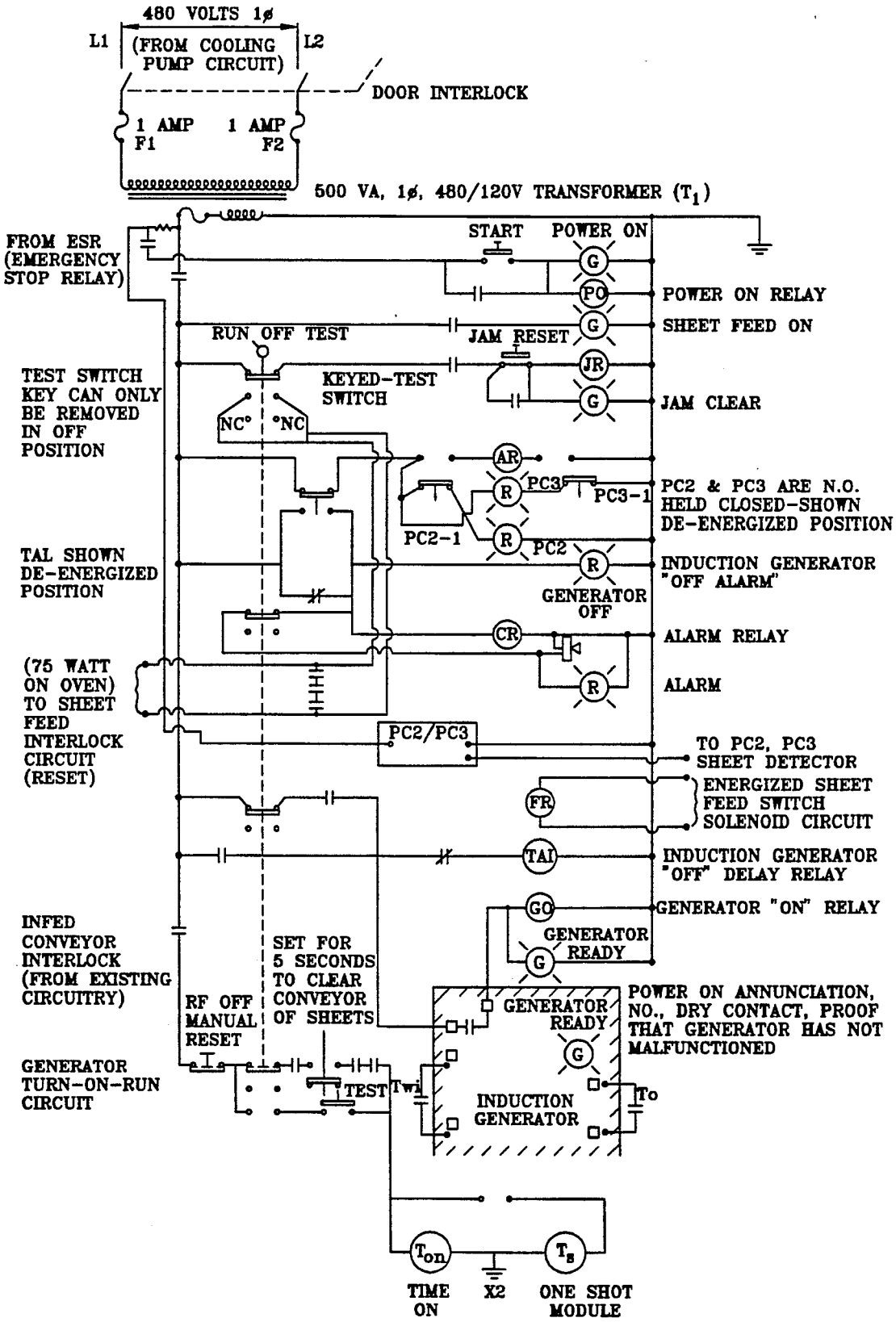
FIG. 5 is a schematic diagram of the control circuit utilized in the present invention.

The relevant control circuit is illustrated in FIG. 5. PC2-1 and PC3-1 contacts are normally open, but are held closed when the infrared proximity switches are turned on without sheets 4 on the conveyor belt 15. In one system, these contacts have up to a three second delay to open should a sheet 4 jam remain under a detector PC-2 or PC-3. During normal operation, the sheet passes by the detector in less than three seconds allowing the timer to reset itself between sheet intervals, thus it never times out.

Referring again to FIG. 5, power is applied to transformer $T_1$ when the cooling pump circuit of the induction coil 26 is energized, provided the door interlock disconnect switch is closed. Activating the start button pulls in the power on relay and energizes the control circuit through contacts PO-2, assuming the emergency stop is energized. Once the convection oven 40 and conveyor 14 are operating, the in-feed conveyor interlock for conveyor 14 is closed. PC2-1 and PC3-1 contacts are closed, providing the respective pick-ups do not indicate a sheet jam. Relay AR is energized. When the test switch is in the run position and FR feed relay is energized, FR2 closes which turns on $T_{on}$ which energizes $T_s$ one shot for the induction coil 26. Relay contacts FR1 also close pulling in TAL (time alarm relay). When the generator comes on, GO (generator on relay) becomes energized. Contacts GO-1 open and TAL drops. TAL-1 contacts are set for three seconds to prevent the alarm relay AR from dropping out. If the generator fails to come on, GO relay will not put in and TAL will time out, causing the alarm to sound and sheet feed AR-3 to open.

When the test switch is in the off position, the circuit is by passed and conventional oven operation can be maintained. The key can only be inserted or removed from the switch in this position. In order to manually test the generator, the switch must be manually held in the test position.

The user has the option of field wiring the sheet feed interlock circuit so that sheets can be fed in the test position.

Power for the infrared or LED photocells PC-2 and PC-3 is derived from X1-A and X-2 mains. X2 is grounded to maintain radio frequency effect in the control circuit.

The conveyor 14 includes an insulated table top generally indicated at 19 in FIG. 2. When inductively heating metal strip, in say coil form, the strip itself becomes the mechanical conveyor mechanism. Inductive currents are dissipated within the strip itself so that a supporting conveyor adjacent to the induction load coil is not required. Heating discrete units such as ferromagnetic metal sheets 4 requires the use of a support mechanism, an electrically insulated conveying device. The reason for this is as follows. As each sheet 4 passes through the flux field generated by the induction coil, a current along with a voltage potential is produced across the sheet. The sheet at all times, when in the vicinity of the induction coil magnetic field, must be kept from contacting any type of electrically conducting surface. The voltage potential across the sheet 4 produced by the magnetic field flux is only a few volts, but the induced currents are excessive. It is these induced currents or eddy currents that cause the heating within the ferromagnetic sheet. If the sheets were to contact the frame of conveyor 14 in two areas, such as each edge of the sheet contacting the conveyor while the sheet is passing through the coil, a short circuit would be produced across the sheet 4 and through the conveyor 14. This short circuit changes the flux distribution within the sheet, producing an uneven heating pattern. The support conveyor in this case generally illustrated in FIG. 2 is made of reenforced plexiglass to eliminate the short circuit currents.

The apparatus also includes an insulated sheet riser generally indicated at 20. These insulated risers serve to raise the sheet as it moves off of conveyor 14 to be conveyed into the wickets 41 of the convection oven 40. These sheets need to be insulated because, if sheets 4 being cured are long so that the leading edge of the sheet would contact the sheet riser before the trailing edge of the sheet was out of the influence of the induction coil's flux field, short circuits would be produced between the sheet, the conveyor frame and the risers 20 contacting the sheet. In order to overcome this, it is necessary to insulate the risers 20 from the frame of the conveyor 14 to eliminate the unwanted short circuit currents.

Also in the conveyor system 10, there may be insulated sheet ejector fingers 21 which may be operable when the double sheets detector 18 indicates a double or overlapped sheets. These fingers 21 will be automatically raised to divert the double sheets to the sheet reject tray 22 positioned above the coil 26. Alternatively, the double sheet detector can sound an alarm and an operator can manually operate the fingers 21 to remove a double sheet.

The conveyor system 10 further includes a vacuum hold down mechanism consisting of a vacuum pump 30 with hoses 31, 32 and 33 leading to plenum chambers under conveyor belts 12*b* and 15*b*, respectively. These hoses draw a vacuum through the porous belt on conveyor 12 and the porous antistatic conveyor belt 15*b* and belt 12*b* to hold the sheets on the conveyors. This is particularly required when the sheet is within the induction coil 26 as the magnetic field will tend to cause the ferromagnetic sheets 4 to levitate.

Figure 3:
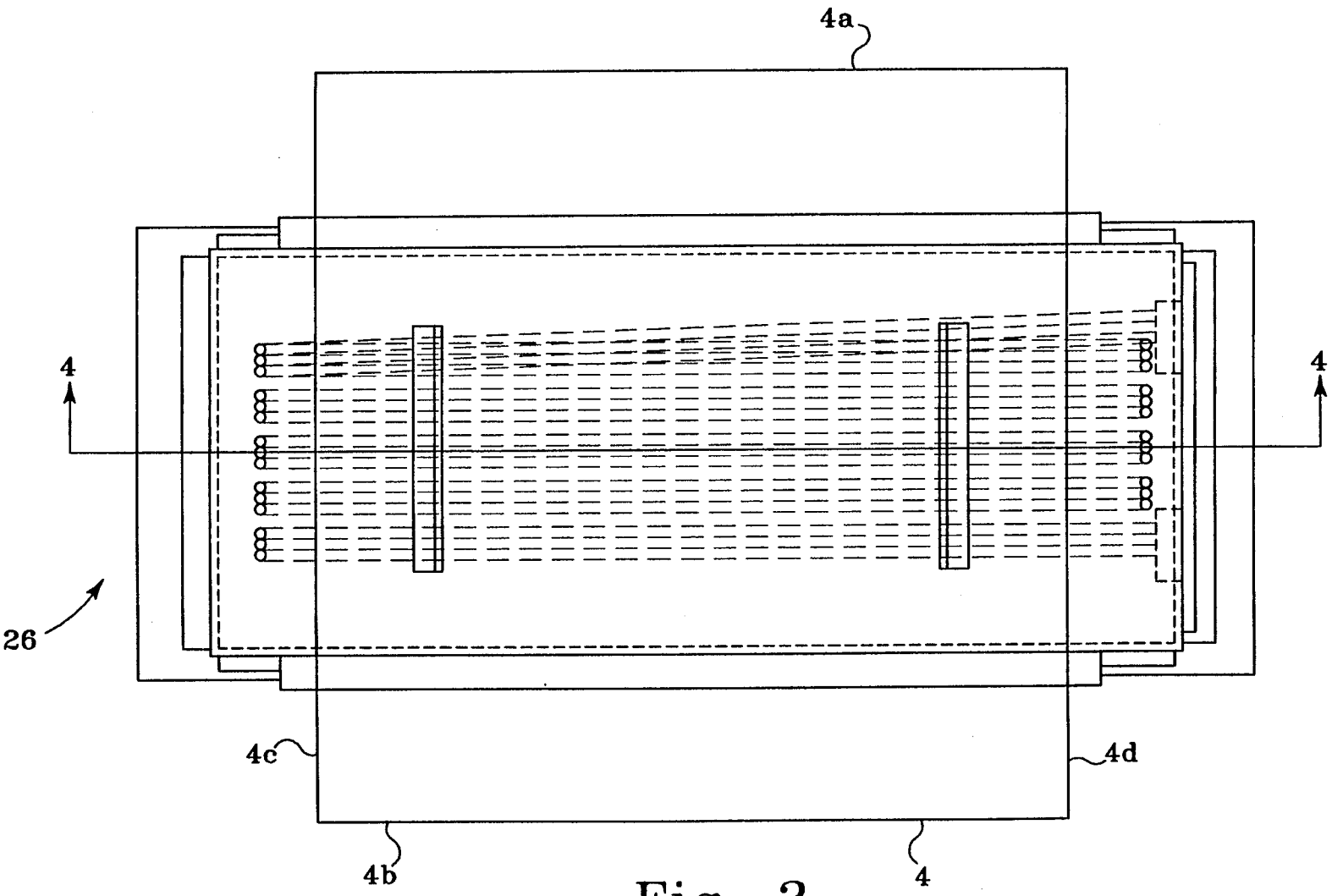
FIG. 3 is a plan view of the induction coil utilized in the present invention.
Figure 4:
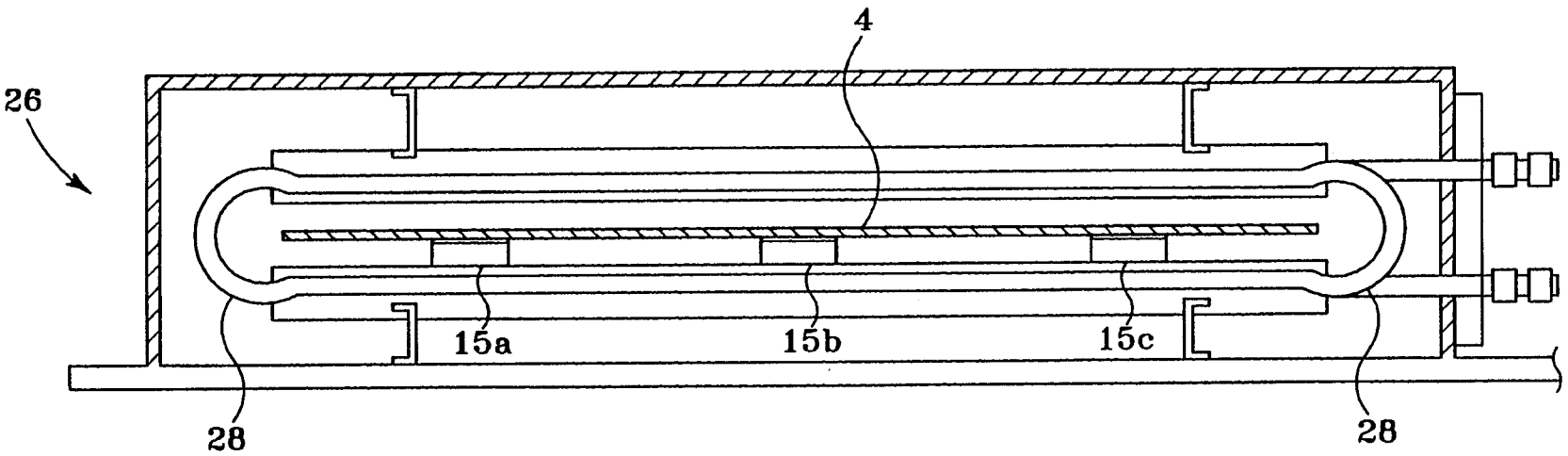
FIG. 4 is a sectional view of the induction coil taken on the line 4—4 of FIG. 3.

Referring to FIGS. 3 and 4, the induction coil 26 is generally indicated. This induction coil is contained within an insulated housing 27 and consists of a plurality of turns 28 of copper tubing 29 in a manner generally known to those skilled in the art of induction coils. In this case, however, the induction coil is significantly narrower than the length of the sheet in the direction of travel and is designed to concentrate the flux field in a narrow band across the width of the sheet 4, i.e., transverse to the direction of movement of the sheet through the coil. In this way, as the sheet 4 is conveyed through the induction coil 26, the sheet is heated at a substantially even gradient across the width of the sheet, i.e., plus or minus 5° F. This is particularly pertinent if the sheet has scalloped edges so that the edges of the sheet are not overheated and deformed. It is important that the coil be narrower than the length of the sheet so that the leading edge 4*a* and the trailing edge 4*b* of the sheet 4 are not overheated. As will be seen in FIG. 4, the coil is a pancake toroidal or flattened solenoid shape with expanded ends 28 so that the edge of the sheet 4*c* and 4*d* remain substantially equidistant from the coil turns at the center of the sheet to be sure that those edges are not overheated and deformed.

The coil for this application was designed to provide efficient coupling (98% plus) between the sheet 4 and the magnetic flux field generated by the induction coil, and yet maintain sufficient clearance to prevent the sheet from jamming in the coil along with keeping the high voltage coils at a safe distance from the sheet. The coil was designed narrower than the prior art to produce an even, narrow (air knife effect) heating parameter or band across the total width of the sheet, i.e., transverse to the direction of movement of the sheet through the coil. This narrow heat parameter prevents circulating currents that occur within the sheet as compared to the use of a wider coil. When used with an apparatus capable of inductively heating sheets up to 54 inches by 56 inches, the width of the heating parameter is concentrated within a 3 inch width keeping the eddy currents concentrated within a narrow band across the sheet. By keeping the band narrow, tests indicated that even heating across the width of a sheet occurs. If the coil was designed to produce a wider magnetic flux, excessive circulating currents would appear in the corners, along the sheet edges and between the tabs of a scroll scalloped edge cut sheet.

Voltages and currents in excess of several hundred volts are produced in and across the coil, so for safety reasons, the coil is completely enclosed by an insulated housing 27, which in turn may be wrapped in an aluminum shield. Preferably, the enclosure may be made large enough to prevent the inductive heating of foreign objects, such as tools, which may be placed on top of the enclosure. Induction coils are fabricated from copper tubing which are water cooled. In one embodiment, the coil is made with five turns with three tubes each. There is a three inch opening between the top and bottom portions of the coil. The ends at 28 are opened to maintain the same distance between the edge of the sheet and the coil as is maintained in the center of the coil. This prevents arcing between the coil and the sheet and overheating of the sheet which could cause deformation, particularly at the edges. The current transformer monitors the current through the coil at all times.

The coil needs to be capable of withstanding currents in excess of 700 amperes, be compact, water cooled, but, to prevent condensation, not so excessively cooled that the dew point is exceeded, and should be isolated from the sheet metal substrate to prevent arcing between the coil and the substrate. Arcing could cause the solvents previously applied to the sheet to ignite causing a fire. The coil must be totally enclosed to prevent employee contact and also to prevent parts, such as tools, from becoming inductively heated should they be placed on the enclosure. The coil should provide an energy transfer efficiency of 98% or better. This efficiency is based on the input power, voltage and currents compared to the substrate mass-temperature relationship of the ferromagnetic substrate.

It was discovered that if the coil is too large, generating too large a magnetic flux field, uneven heating of the substrate occurred.

Since the sheet is a very thin layer compared to its length and width, even heat distribution is a critical concern since the temperature variance across the entire sheet must be maintained within five degrees if even coatings-ink curing is to be maintained.

With the solenoid design or pancake toroidal configuration shown in FIGS. 3 and 4, a coated-lithographed sheet is passed through the center of the coil where the magnetic field flux is concentrated. This design not only eliminates the uneven heating of the sheet which occurs if a flat coil is used wherein the sheet is passed under the coil, but also increases the efficiency of the coil because the substrate intersects most of the coil's magnetic field flux.

The first problem encountered with the solenoid design was the overheating of the sheet edges or scroll tabs. Further investigation revealed a concentration of the magnetic field flux where the coil end loop (turns) are made. By widening the end turns, the magnetic flux concentration decreased in the sheet side edge area. The further the coil's end turns are located from the sheet substrate, the less dense the magnetic field flux becomes; hence, the sheet side edge overheating condition is corrected, compared to a semi-circular connection between the top of the coil and the bottom of the coil. With the configuration shown, even heating of the metal substrate has been maintained within plus or minus five degrees Fahrenheit over the 200° to 500° F. operating range of the induction coil 26.

The coil windings have been sized to accommodate 200 kilowatts of power. The coil design parameters were followed based on computer printouts and electrical tables based on past operating experience in other induction heating applications.

The coil enclosure insulating support material is reinforced fiberglass, commercial trade name "Extren". Extren is a commercial material sold by Joseph T. Ryerson & Son, Inc., Chicago, Ill. This material has a high dielectric, high electrical resistivity, is not water or acid soluable, plus it is very rigid. Attached to the Extren fiberglass coil and conveyor supports is an aluminum shield (enclosure) approximately ⅛ inch thick which completely surrounds the coil. The shield acts as a protective barrier so to protect the operator from accidentally dropping a sheet or tool on the coil.

The coated sheet passes through the center of the coil. For a 44 inch maximum sheet width, the coil opening is three inches high by four feet wide. Extren sheeting is used to prevent the sheet from physically making contact with the coil to eliminate any arcing that could occur and a possible shock hazard.

It is important to note the coil and enclosure are supported on insulated beams. In the preferred form, the total sheet conveying system is insulated from ground potential to eliminate the possibility of the sheet from shorting to ground when being heated by the magnetic flux field.

Figure 7:
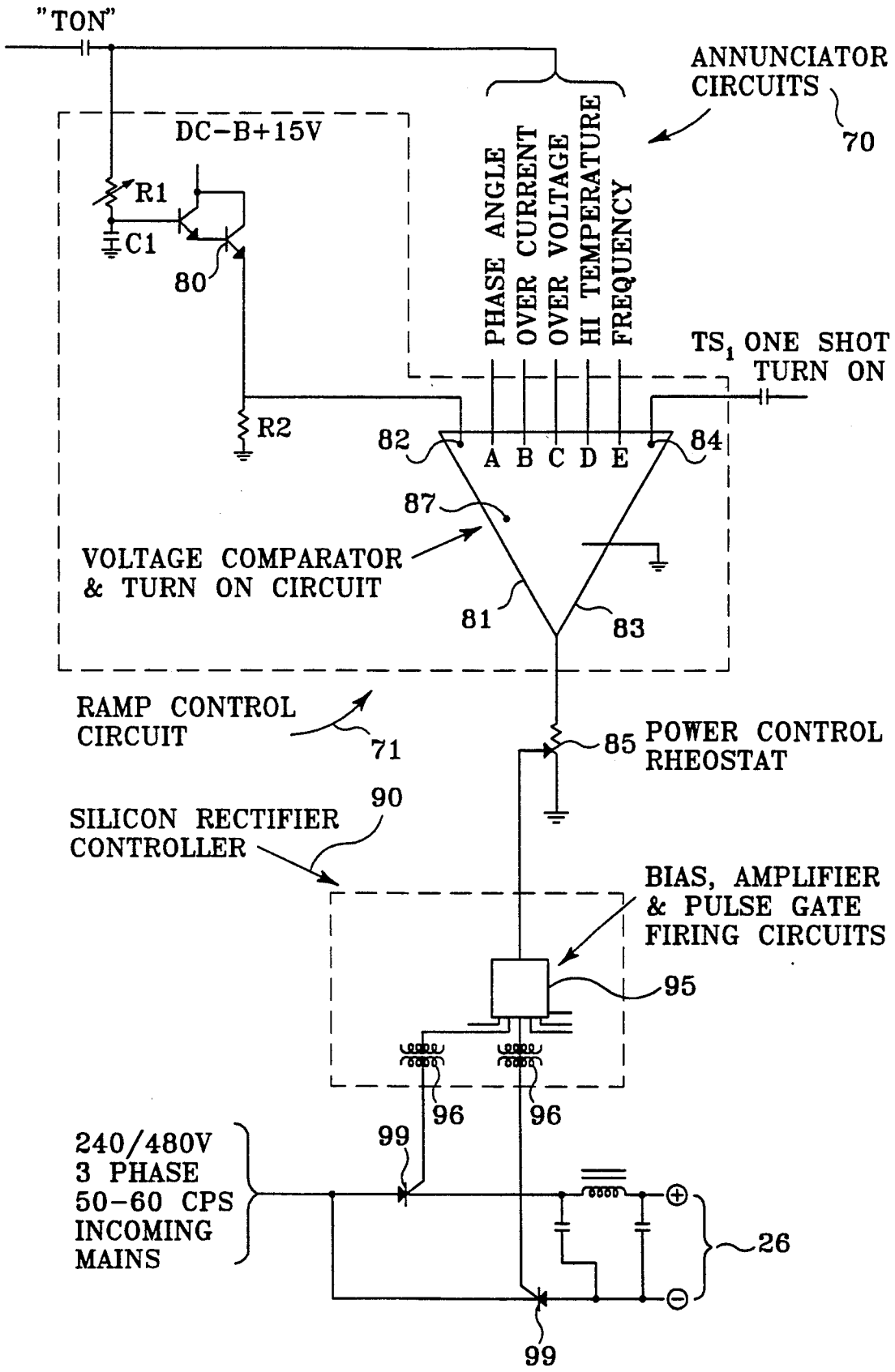
FIG. 7 is a schematic view of the power supply and ramp circuit utilized in the present invention.

The power supply of the present invention includes a means for and process of gradually increasing the power supplied to the induction coil from zero up to a predetermined level. The power supply is generally illustrated in FIG. 7.

The ramp circuit provides an accurate control method for allowing the induction power supply to be turned on under varying load conditions caused by the presence or absence of a sheet within the coil. Most of the time the power supply will be turned on when a sheet is not present in the load coil magnetic flux field generated by the induction coil. Other times, there may be two or more sheets in the induction coil area. The production line illustrated being sheet fed, provides these parameters which the induction power supply must accommodate no-load, full load to over-load sheet heating situations. These situations must be accommodated to prevent excessive voltages and currents from damaging the expensive solid state power modules and devices.

The line operator energizes the feeder sheet feed circuit by turning on the sheet feed switch. This simultaneously energizes the ramp up circuit and induction power supply. The ramp circuit allows the power supply to be turned on in the low power position by maintaining the silicon controlled rectifier (FIG. 7) gate voltages at a safe level in order that the rectifier output voltage is minimized. The ramp circuit allows for a gradual steady increase in the silicon controlled rectifier gate voltage so that maximum set power is achieved in approximately three seconds. The final power setting or output of the power supply is determined by the power setting potentiometer or rheostat (FIG. 7) located on the front control panel of the power supply. The power setting potentiometer is operator adjustable.

The ramp circuit prevents out-of-phase silicon controlled rectifier gate firing conditions which would exist if the power supply were turned on and off again in rapid succession. It also provides the annunciator detection circuits ample time to detect if the phase current of the oscillator modules is properly adjusted to provide appropriate power to the output station.

Referring to FIG. 7, the induction coil turn on is initiated by energizing the annunciator and the ramp circuit from the master control circuit, FIG. 5, relay contacts $T_{on}$. Once voltage is applied by contact $T_{on}$, the annunciator circuits 70 are immediately energized. The ramp circuit 71 input control voltage is obtained through variable resistor R1 which charges capacitor C1 at a given rate which is established by the amount of applied voltage through contact $T_{on}$, the resistance setting of R1 and the capacitance value of C1.

Two transistors are connected in a Darlington arrangement 80 to provide high impedance input at the resistor R1, capacitor C1 and base junction of the first transistor and low impedance output at the emitter follower of the second transistor. The high impedance input allows an exponential voltage charging rate of capacitor C1 which is fed through the Darlington transistor arrangement 80 across load resistor R2 and to the voltage comparator 81 input pin 82.

Figure 8:
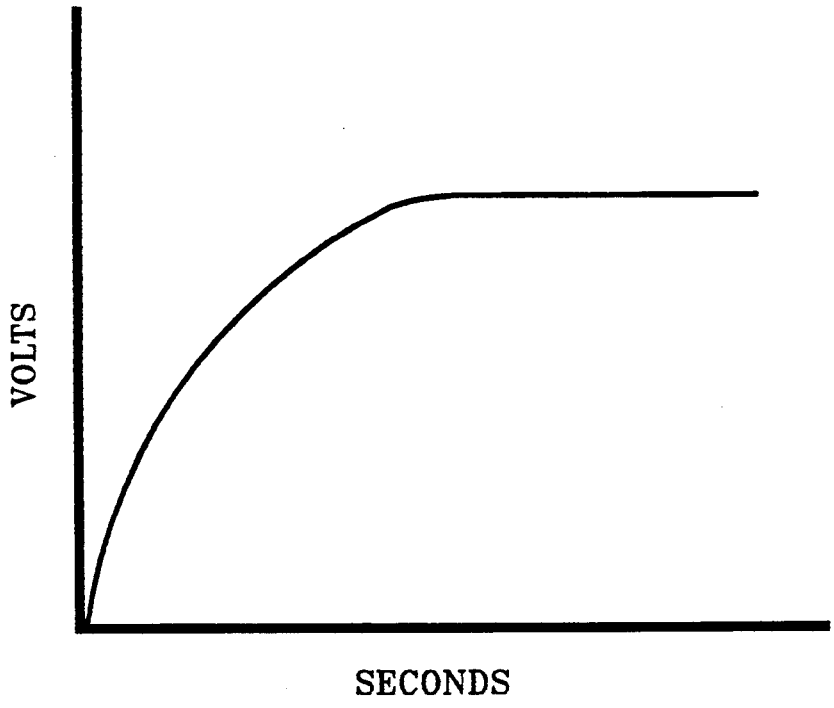
FIG. 8 is a graph showing voltage wave form across a portion of the ramp circuit of FIG. 7.

FIG. 8 is a graph which illustrates the obtained voltage wave form obtained across load resistor R2 and terminal input 82 of voltage comparator 81. If all systems are functioning properly and the annunciator circuits 70 are satisfied, the voltage applied to input pin 82 of the voltage comparator 81 will be available at the comparator's output pin 83, provided a momentary voltage is received from the one shot contact $T_s$. In the preferred embodiment, the one shot pulse of approximately 15 MS duration is delayed a minimum of 200 MS to allow sufficient time for the voltage comparator 81 to evaluate all incoming annunciator circuits 70. If the voltage comparator 81 is satisfied all circuits are functioning properly when the one shot $T_s$ pulse is received on input pin 84, the comparator will allow the present voltage at pin 82, which in the preferred form will be approximately two volts minimum to nine volts maximum.

It is important the comparator evaluate this voltage level because the output voltage of the comparator(s) at pin 83 along with the power control rheostat 85 provides the set power control input voltage to the silicon rectifier controller 90.

If the voltage on pin 82 of the voltage comparator is less than two volts, it signifies problems exist with the external power supply or the contacts of $T_{on}$ are not closing for some reason which may be due, for example, to a sheet jam-up in the induction coil 26 or a failure of the drive of conveyor 14. The voltage comparator 81 must not allow the induction coil 26 to turn on until all conditions are proven and proper voltage is obtained on pin 82 of the voltage comparator 81.

Consequently, if the induction coil were allowed to turn on with the voltage on pin 82 in excess of nine volts (assuming the power control rheostat 85 is set near maximum output), the induction coil would turn on at near maximum power causing high or excessive inrush currents that could destroy the solid state direct current and oscillator power modules along with other solid state electronic control devices.

With proper voltage applied to pin 82 (between two and nine volts in the preferred embodiment) and all annunciator systems 70 proven, the voltage comparator 81 will turn on and allow the voltage at pin 82 to conduct through the comparator 81 resulting in a voltage across power control rheostat 85. Capacitor C1 continues to charge for approximately three seconds until maximum voltage is obtained which provides approximately 13 volts to pin 82 of voltage comparator 81. The voltage comparators turn-on circuit will maintain the voltage at pin 87 within less than one volt of the incoming applied voltage to pin 82, unless voltage is lost on pin 82 or one or more of the annunciator circuits fail, which then causes the turn-on circuit to drop out shutting down the induction coil 26.

Power control rheostat 85 is located externally of the ramp circuit 71 and is adjusted by the operator to provide the desired power level or voltage input to the silicon rectifier controller 90.

Conventional bias, amplifier and pulse gate firing circuits 95 for the silicon controlled rectifiers 99 are employed. Electrical isolation for the pulse gate firing circuits 95 is provided by six each, SCR isolation transformers 96.

Filter choke 97 and filter capacitors 98 filter the DC ripple so that constant direct current power is furnished to the oscillator power modules. Output power from the power modules supply energy to the induction coil 26.

Referring again to FIG. 1, the apparatus also includes a standard convection oven 40. This apparatus includes a convection oven housing 42 with an endless chain conveyor 43 having attached thereto a plurality of wickets 41. These wickets circulate through the gas fired convection oven 40 and hold sheets 4 in a generally horizontal position as they are conveyed through the oven in a well known manner. As will be familiar to those skilled in the art, the oven 40 can be heated to the desired temperature and the speed of the conveyor can be coordinated to achieve the desired baking of the precured coated sheet.

The apparatus also includes a vacuum stop mechanism 60, which is designed to stop the sheets 4, which are discharged from conveyor 14 prior to contacting the conveyor mechanism generally indicated at 45, thereby preventing damage to the sheets. A vacuum stop is generally known to those skilled in the art. The vacuum stop will include a vacuum pump operatively connected to the stop 60. There will be suitable valving means coordinated with conveyor chain sprocket 45, so that each time a wicket moves into a position to receive a sheet discharged from conveyor 10, a vacuum is applied to the stop 60 to "catch" a sheet 4. The wicket then moves up to pick up the sheet and at approximately the same time the vacuum is released. In this invention, the vacuum stop 60 is grounded to dissipate static electricity which is built up in the sheets before contacting the wicket 41 so that arcing does not occur between the wicket and the sheets.

From the foregoing description, the method of the present invention should be apparent. The sheets which have been coated with material in coater 2 are conveyed by the conveyor mechanism 10 through the induction coil 26, whereby the metal is rapidly heated to an initial temperature. In the preferred form, the process includes the step of coordinating the level of energy supplied to the electromagnetic induction coil with the speed at which the metal sheet is conveyed through the magnetic flux field generated by the induction coil to rapidly heat that portion of the sheet that is within the influence of the magnetic flux field generated by the induction coil 26 to the temperature necessary to fume the solvents in the coating in less that 0.5 seconds. Thus, in the preferred embodiment, the sheet is conveyed through the coil and the energy supplied to coil 26 is sufficient so that a band of heated metal across the width of the sheet (air knife effect) may be heated at a rate of 200° F. in 0.3 seconds. The power supplied to the induction coil and the speed of the conveyor 10 will need to be adjusted depending upon the size of the sheet and the coating to be cured. This rapid heating of the metal substrate volatilizes substantially all of the solvents in the coating to precure or dry the coating. The fume produced by the volatilized solvents may be captured in a hood 61 and conveyed through duct 62 to a condenser 63 from which condensed solvents may be conveyed through outlet 64 to a reuse point and exit gases may be discharged through duct 65. The precured sheets conveyed out of the influence of coil 26 are then supplied by conveyor 14 to the second means for curing the coating on the sheet, i.e., the convection oven 40.

In the convection oven, the precured sheet is subjected to a programmed bake. The temperature of the precured sheets is gradually raised from the first temperature achieved by first means 25 up to a second temperature which is that temperature specified by the coating manufacturer and the sheets are maintained at that temperature for the time duration specified by the coating manufacturer to further volatilize solvents and achieve a complete curing of the coating. For example, the precured sheet may be heated in the convection oven to a temperature in the range of 250° to 500° F. and maintained at that temperature for a period up to eight minutes and then gradually cooled to approximately room temperature. In the outlet end of the convection oven (not shown), the programmed bake may include the gradually cooling of the sheets to a temperature suitable for subsequent handling. It is believed that with the present invention, the size of the convection oven can be reduced.

The convection oven 40 may include an exhaust duct 46 for conveying exhaust gases to a suitable air pollution control device 47 and hence to atmosphere through duct 48.

The preferred embodiment of a separate exhaust duct is shown at 62, so that the volatilized solvents do not mix with the combustion gases in the convection oven, producing soot which fouls conveyor mechanisms. If desired, the solvents can be vented through hood 41 to the convection oven for combustion therein and the products of that combustion discharged through duct 46.

In the preferred form, the wickets 41 are preheated to be substantially the same temperature as the precured sheets. If the temperatures are substantially equal, then wicket ghosting can be substantially eliminated.

The present invention includes a new coated metal sheet which is produced by the process of the present invention. This sheet includes a ferromagnetic substrate having a coating applied in liquid form to at least one side of the sheet. The coating includes resin or plastic material dissolved in a solvent. The resin or plastic material may be thermosetting or thermoplastic material. The solvent may be organic or inorganic. Following coating, the sheet is inductively heated to rapidly raise the temperature of the sheet to a first temperature sufficiently high to fume solvents contained in the liquid coating and precure the coating, for example 200° F. The sheet with the precured coating is immediately conveyed to a convection oven where it is subjected to a preprogrammed bake by heating the sheet to a second temperature (for example 800° F.) and maintaining the coated sheet at the second temperature for a period of time sufficient to cure the coating (for example 5 minutes) and then the sheet is cooled. The specific temperatures and heating duration will depend on the particular coating being used.

In view of the foregoing, it should be apparent that the objects of this invention have been carried out. Since solvents are more readily driven from the coatings and inks using induction and conventional heating processes simultaneously, an improved homogeneous heat curing cycle is accomplished which results in a better coated sheet through better adhesion between coating and/or the substrate along with providing more durable coating and ink surfaces to better accommodate any cutting and forming operations that may follow.

While the invention has been particularly described with respect to curing the coating on individual sheets, the basic concept of the invention is applicable to other metal substrate in coil or wire form.

It is intended that the invention be limited solely by that which is within the scope of the appended claims.

We claim:

1. A process for drying and curing a coating on a metal substrate, comprising the steps of inductively heating a coated metal substrate to rapidly heat the coated metal substrate to a first temperature sufficient to substantially dry the coating; and further gradually heating the coated metal substrate until the coated metal substrate has been raised to a second temperature and maintaining said second temperature for a sufficient duration to cure the coating.

2. A process for drying and curing a coating on a metal substrate according to claim 1 wherein the step of inductively heating the coated metal substrate is substantially immediately followed by a step of heating the coated metal substrate in a convection oven.

3. A process for drying and curing a coating on a metal substrate according to claim 1 wherein the step of further heating the coated metal is carried out by gradual heating in a convection oven and the metal substrate is inductively heated to a temperature at least as high as the temperature at the inlet of the convection oven.

4. A process for drying and curing a coating which has been applied in a liquid form on discrete units of metal substrate, comprising the steps of:

providing an induction coil;

providing a convection oven;

conveying the discrete units of coated metal substrate just through the induction coil for heating each of the discrete units to a first temperature for drying the coating which has been applied to the discrete units, then through the convection oven for further heating the discrete units for curing the coating which has been applied to the discrete units; and supplying sufficient energy to the convection oven to elevate the temperature of the discrete units from the first temperature to a second temperature and for maintaining said second temperature for a duration sufficient to comply with predetermined curing specifications of the coating being cured while the discrete units are within the convection oven.

5. A process for drying and curing a coating according to claim 4 wherein the discrete units are continuously conveyed and further comprising the step of supplying sufficient electrical energy to the induction coil to heat the metal substrate to a first temperature sufficient to fume substantially all of the solvents in the coating.

6. A process for drying and curing coatings according to claim 4 further comprising the step of gradually increasing the energy supplied to the induction coil from zero up to a preset power level, prior to conveying the discrete units of metal substrate through the induction coil.

7. A process for at least partially curing a coating which has been applied to a metal sheet comprising the steps of:

energizing an electromagnetic induction coil, conveying a coated metal sheet through the magnetic flux field of the induction coil, and coordinating the level of energy supplied to the induction coil with the speed at which the metal sheet is conveyed through the magnetic flux field to heat that portion of the metal sheet which is within the influence of the magnetic flux field to a temperature sufficient to fume solvents contained in the coating in about 0.5 seconds or less.

8. A method for curing a coating which has been applied sequentially to a plurality of individual sheets of a ferromagnetic substrate comprising precuring the coating by heating the substrate to rapidly raise the temperature of the ferromagnetic substrate to a first temperature sufficient to volatilize at least 50% of the solvents contained in the coating; subjecting the coated substrate to a preprogrammed bake by gradually heating the sheets to a second temperature; and maintaining the coated sheet at said second temperature for a period of time sufficient to cure the coating.

9. A method for curing a coating which has been applied to a plurality of individual sheets of a ferromagnetic substrate according to claim 8 wherein the step of precuring the coating is carried out by conveying the individual sheets serially through an energized induction coil for inductively heating the substrate and the step of subjecting the coated substrate to a preprogrammed bake is carried out in an oven separate from the means for inductively heating the substrate and the individual sheets are conveyed substantially immediately from the means for inductively heating the substrate to the separate oven.

* * * * *